US006158209A

United States Patent [19]

Latischev et al.

[11] Patent Number: 6,158,209

[45] Date of Patent: Dec. 12, 2000

[54] DEVICE FOR CONCENTRATING ION BEAMS FOR HYDROMAGNETIC PROPULSION MEANS AND HYDROMAGNETIC PROPULSION MEANS EQUIPPED WITH SAME

[75] Inventors: Leonid Aleckseevich Latischev; Akhmet Mialikovich Iakubov, both of Moscow, Russian Federation; Aidar Beksultanovich Jacoupov, Alma Ata, Kazakhstan; Sergey Anatolievich Khartov, Moscow, Russian Federation; Dominique Valentian, Rosny, France

[73] Assignee: Societe Nationale d'Etude et de Construction de Moteurs d'Aviation-S.N.E.C.M.A., Paris, France

[21] Appl. No.: 09/230,219

[22] PCT Filed: May 23, 1997

[86] PCT No.: PCT/FR97/00906

§ 371 Date: Jan. 21, 1999

§ 102(e) Date: Jan. 21, 1999

[87] PCT Pub. No.: WO98/53201

PCT Pub. Date: Nov. 26, 1998

[51] Int. Cl.[7] ..... H05H 1/00

[52] U.S. Cl. ..... 60/202; 60/203.1; 313/361.1; 315/111.81

[58] Field of Search ..... 60/202, 203.1; 313/361.1; 315/111.81, 111.91

[56] References Cited

U.S. PATENT DOCUMENTS

| | | | |
|---|---|---|---|
| 3,363,124 | 1/1968 | Bensussan et al. | 313/361.1 |
| 4,466,242 | 8/1984 | Sovey et al. . | |
| 5,150,010 | 9/1992 | Kageyama | 315/111.81 |
| 5,646,479 | 7/1997 | Aston | 60/202 X |
| 5,889,371 | 3/1999 | Boyarsky et al. | 315/111.81 |

FOREIGN PATENT DOCUMENTS

| | | |
|---|---|---|
| 2 271 044 | 3/1994 | United Kingdom . |
| WO 89/05404 | 6/1989 | WIPO . |
| WO 95/00758 | 1/1995 | WIPO . |

*Primary Examiner*—Timothy S Thorpe
*Assistant Examiner*—David J. Torrente
*Attorney, Agent, or Firm*—Weingarten, Schurgin, Gagnebin & Hayes LLP

[57] ABSTRACT

The ion beam concentration apparatus for a plasma thruster having closed electron drift comprises:

a) an essentially frustoconical flared magnetic pole piece (63) open at both ends and designed to be situated downstream from the outlet plane of a plasma thruster having an annular ionization and acceleration channel (1) and peripheral and central pole pieces (3, 4) disposed on either side of the annular channel (1) to produce an essentially radial magnetic field in an outlet plane (14) perpendicularly to the axis of the annular channel (1); and b) an additional peripheral magnetic circuit (60; 80) connecting the downstream end of the flared magnetic pole piece (63) to said peripheral pole piece (3), the flared magnetic pole piece (63) co-operating with the additional peripheral magnetic circuit (60; 80) and with the peripheral and central pole pieces (3, 4) to define the shape of the magnetic field downstream from the annular channel (1) in such a manner as to constrain the ion beam emitted by the annular channel (1) to remain within an essentially conical zone whose predetermined angle at the apex is defined by the angle at the apex of the flared magnetic pole piece (63).

20 Claims, 7 Drawing Sheets

PRIOR ART

PRIOR ART

DEVICE FOR CONCENTRATING ION BEAMS FOR HYDROMAGNETIC PROPULSION MEANS AND HYDROMAGNETIC PROPULSION MEANS EQUIPPED WITH SAME

FIELD OF THE INVENTION

The present invention relates to electro-ionic plasma thrusters as applied in particular to propulsion in space, and also to industrial processes on the ground, and more particularly to plasma thrusters of the closed electron drift type, also known as stationary plasma thrusters (SPT), as Hall-effect thrusters, or as anode layer thrusters (ALT).

PRIOR ART

Thrusters of the closed electron drift type or thrusters of the stationary plasma type are already known, in particular from an article by L. H. ARTSIMOVITCH et al., published in 1974, and relating to the stationary plasma thruster (SPT) development program and testing on the "METEOR" satellite, which thrusters differ from other categories of ion thrusters by the fact that ionization and acceleration are not separated, and the acceleration zone includes equal numbers of ions and of electrons, thereby making it possible to eliminate any space charge phenomena.

A closed electron drift thruster as proposed in the above-mentioned article by L. H. ARTSIMOVITCH et al. is described below with reference to FIG. 6.

An annular channel 1 defined by a piece 2 of insulating material is placed in an electromagnet comprising an outer annular pole piece 3 and an inner annular pole piece 4 placed respectively outside and inside the piece 2 of insulating material, a magnetic yoke 12 disposed at the upstream end of the thruster, and electromagnet coils 11 which extend over the full length of the channel 1 and are connected in series around magnetic cores 10 connecting the outer pole piece 3 to the yoke 12. A hollow cathode 7, connected to ground, is coupled to a xenon feed device 17 to form a cloud of plasma in front of the downstream outlet from the channel 1. An annular anode 5 connected to the positive terminal of an electrical power supply, e.g. at 300 volts, is disposed in the closed upstream portion of the annular channel 1. A xenon injection tube 6 co-operating with a thermal and electrical insulator 8, opens out into an annular distribution channel 9 disposed in the immediate vicinity of the annular anode 5.

The ionization and neutralization electrons come from the hollow cathode 7. The ionization electrons are attracted into the insulating annular channel 1 by the electric field that obtains between the anode 5 and the plasma cloud coming from the cathode 7.

Under the effect of the electric field E and of the magnetic field B created by the coils 11, the ionization electrons follow an azimuth drift trajectory suitable for maintaining the electric field in the channel.

The ionization electrons then drift along closed trajectories inside the insulating channel, which is why the thruster is called a "closed electron drift" thruster.

The drift motion of the electrons considerably increases the probability of electrons colliding with neutral atoms, which phenomenon produces ions (in this case of xenon).

The magnetic field is defined by the shapes of the pieces 3 and 4. The magnetic field lines 13 are essentially radial in the outlet plane 14 of the thruster.

Closed electron drift thrusters thus make use of ion acceleration within a plasma. The ions do not all have the same energy. To a first approximation, the ion beam has two components:

a relatively narrow high energy component coming from the ionization region upstream from the acceleration channel 1; and a highly divergent low energy component which appears from the outlet of the acceleration channel 1 and expands in the volume situated immediately downstream from the outlet plane 14 of the thruster.

FIGS. 8*a* and 8*b* show how ion current is distributed as a function of energy for an ion thruster operating at a discharge voltage Vca of 300 V.

FIG. 8*a* has six curves corresponding to respective angles of 0°, 7°30', 15°, 22°30', 30°, and 37°30' relative to the axis of the thruster. It can be seen that the ion current has a peak corresponding to 270 eV, and of an amplitude that drops off quickly when the angle relative to the axis of the thruster increases. This main peak is due to the primary ions. Secondary ions produced in the outlet plane of the thruster form a secondary peak corresponding to energy in the range 20 eV to 30 eV. The amplitude of the secondary peak is practically independent of the angle of divergence relative to the axis of the thruster.

On a larger scale, FIG. 8*b* shows five curves corresponding to the following angles respectively: 37°30', 45°, 52°30', 60°, and 67°30'. It can be seen that the density of high energy ions decreases very quickly for high values of angle of divergence from the axis of the device. Nevertheless, for an angle of divergence of 67°30', there still remains a non-negligible percentage of ions at an energy in excess of 100 eV. On being projected, these ions are capable of causing damage.

FIG. 9 shows the angular distribution of low energy ions and of high energy ions and it gives an overall view of the profile of the beam. Solid line curve 31 shows the value of the ion current as measured in a collector at 30 V as a function of angle of divergence from the axis of the thruster, and dashed line curve 32 gives the value of the ion current as measured in a 50 V collector, likewise as a function of angle of divergence from the axis of the thruster.

In FIG. 9, it can be seen that the density peak 33, 34 centered on 0° is the contribution of high energy ions coming from the ionization front situated inside the acceleration channel, while the broadly-spread distribution of low density corresponds to the low energy ions.

FIG. 7 shows a portion of the conventional closed electron drift thruster of the kind described with reference to FIG. 6. In FIG. 7, there can be seen arrows 52 showing the orientations of the ion speed vectors, together with a dashed line curve 51 showing the distribution of ion density, immediately at the outlet from the acceleration channel 1. The magnetic field lines 113 at the outlet of the acceleration channel 1 as created by the pole pieces 3 and 4 and by the coils 11 and 15 are also shown superposed on the representation of ion distribution. It can be seen that the ion trajectories are perpendicular to the magnetic field lines. It follows that the ion trajectories 54 and 56 at points 53 and 55 situated at the periphery of the acceleration channel 1 downstream from its outlet plane 14 are practically perpendicular to the axis Z of the thruster.

The trajectory of the ions in the low energy and highly divergent component of the ion beam as governed by the magnetic field lines corresponding to equipotentials, can have a highly damaging effect on the surface of the space vehicle on which the thruster is mounted.

In industrial applications, in particular in installations for ion beam spraying, the fact of having a beam that does not have well-defined frontiers can also cause problems, since the beam extends beyond the target and strikes the wall of the enclosure of the apparatus, thus contaminating the coating thereof.

OBJECT AND BRIEF SUMMARY OF THE INVENTION

The invention seeks to remedy the above-mentioned drawbacks and to enable an ion beam to be produced at the outlet from the thruster having an outline that is well defined and an ion density of distribution that it optimized to avoid attack from low energy ions situated at the periphery of the beam.

These objects are achieved by a closed electron drift plasma thruster comprising:

an annular ionization and acceleration channel defined by pieces of insulating material having an opening at its downstream end;

at least one hollow cathode disposed outside said annular channel and downstream therefrom;

an annular anode concentric with the annular channel and disposed upstream from the opening of said channel, and at a distance therefrom;

first and second ionizable gas feed means respectively associated with the hollow cathode and with the annular anode; and a magnetic circuit for creating a magnetic field in the annular channel, said magnetic circuit comprising a plurality of distinct magnetic field creating means, a yoke, a peripheral magnetic circuit disposed axially outside the annular channel, and pheripheral and central pole pieces connected to one another by said peripheral magnetic circuit and said yoke and disposed on either side of the annular channel to produce an essentially radial magnetic field in an outlet plane perpendicular to the axis of said annular channel;

the thruster being characterized in that it further comprises:

an essentially frustoconical flared magnetic pole piece open at both ends, coaxial about the axis of the annular channel, situated downstream from said outlet plane, and flaring downstream; and at least one additional peripheral magnetic circuit connecting the downstream end of said flared magnetic pole piece to the peripheral pole piece situated outside the auxiliary channel, the flared magnetic pole piece co-operating with the additional peripheral magnetic circuit and the pole pieces situated on either side of the annular channel to define the shape of the magnetic field downstream from the annular channel in such a manner as to constrain the ion beam emitted by the annular channel to remain within an essentially conical zone whose determined angle at the apex is defined by the angle at the apex of the flared pole piece.

Thus, according to the invention, the ion beam at the outlet from the annular acceleration channel is constrained to remain within a cone whose half-angle at the apex is defined by the half-angle at the apex of the flared pole piece, without it being essential for the half-angle at the apex of the conical ion beam to be exactly equal to that of the flared pole piece.

The flared pole piece situated downstream of the usual outlet plane from the acceleration channel serves essentially to shape the magnetic field downstream from the outlet plane and thereby to modify the equipotential surfaces outside the thruster and the ion trajectory so as to make the ion trajectory more directional and avoid any risk of damaging outside walls situated in the vicinity of the ion beam.

It will be observed that the flared pole piece is itself protected against attack by the ions since the trajectories of the peripheral ions are essentially tangential to said flared pole piece.

The half-angle at the apex, $\alpha$, of the essentially frustoconical flared pole piece lies in the range 30° to 60°.

Advantageously, the half-angle at the apex, $\alpha$, of the essentially frustoconical flared pole piece is about 45°.

In a particular embodiment, the flared pole piece is curved such that the angle formed by said piece relative to the axis of the thruster increases on going away from the outlet plane in the downstream direction, thereby enabling the magnetic field lines to spread apart progressively.

According to an advantageous characteristic, the flared pole piece is covered in a coating for increasing the emissivity of the surface of said piece, for providing electrical insulation, or for providing protection against contamination between the annular channel and the flared pole piece.

The coating may be made of a material identical to that of the pieces defining the annular channel, and it may be constituted by at least one of the following materials: aluminum, boron nitride, silica, aluminum nitride, silicon nitride, $Al_2O_3$—$TiO_2$, and TiN.

In a possible embodiment, the additional peripheral magnetic circuit is constituted by a single ferromagnetic ring.

More particularly, the hollow cathode is incorporated in a hole formed in the flared pole piece and is provided with a ferromagnetic protective screen facing the local magnetic field.

The additional peripheral magnetic circuit may also include ferromagnetic bars.

In which case, in a particularly advantageous embodiment, said ferromagnetic bars are made of soft iron and are surrounded by coils whose winding directions are such that the magnetic flux created in the additional peripheral magnetic circuit is directed in a direction opposite to that of the magnetic flux created in said peripheral magnetic circuit disposed axially outside the annular channel.

The invention also provides ion beam concentration apparatus for a plasma thruster having closed electron drift, the apparatus being characterized in that it comprises:

a) an essentially frustoconical flared magnetic pole piece open at both ends and designed to be situated downstream from the outlet plane of a plasma thruster having an annular ionization and acceleration channel and peripheral and central pole pieces disposed on either side of the annular channel to produce an essentially radial magnetic field in an outlet plane perpendicularly to the axis of the annular channel; and b) an additional peripheral magnetic circuit connecting the downstream end of the flared magnetic pole piece to said peripheral pole piece, the flared magnetic pole piece co-operating with the additional peripheral magnetic circuit and with the peripheral and central pole pieces to define the shape of the magnetic field downstream from the annular channel in such a manner as to constrain the ion beam emitted by the annular channel to remain within an essentially conical zone whose predetermined angle at the apex is defined by the angle at the apex of the flared magnetic pole piece.

BRIEF DESCRIPTION OF THE DRAWINGS

Other characteristics and advantages of the invention appear from the following description of particular embodiments, given as non-limiting examples, and with reference to the accompanying drawings, in which.

DETAILED DESCRIPTION OF PARTICULAR EMBODIMENTS

Figure 1:
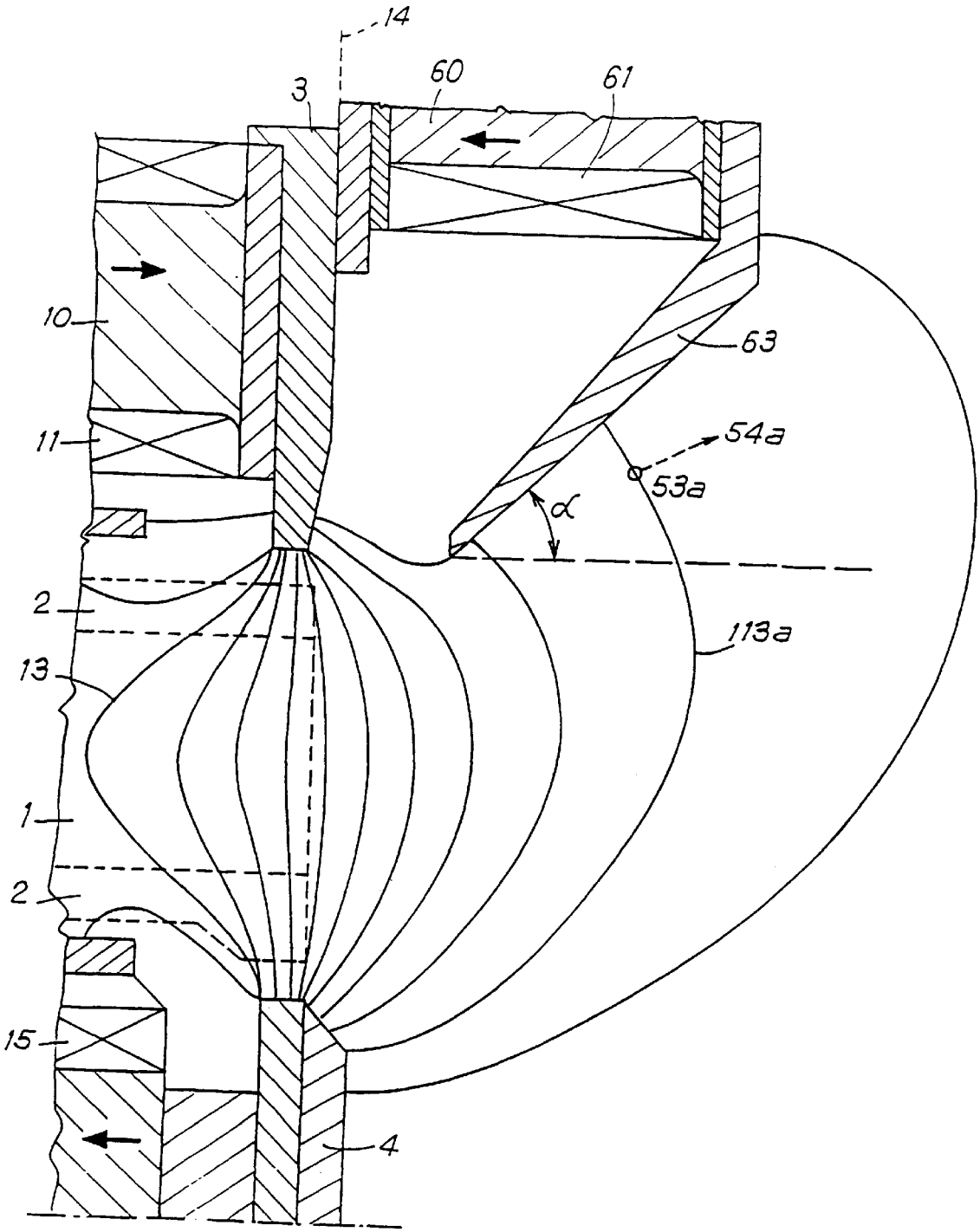
FIG. 1 is an axial section view of a portion of a closed electron drift plasma thruster fitted with a beam-shaping device constituting a first particular embodiment of the invention.
Figure 7:
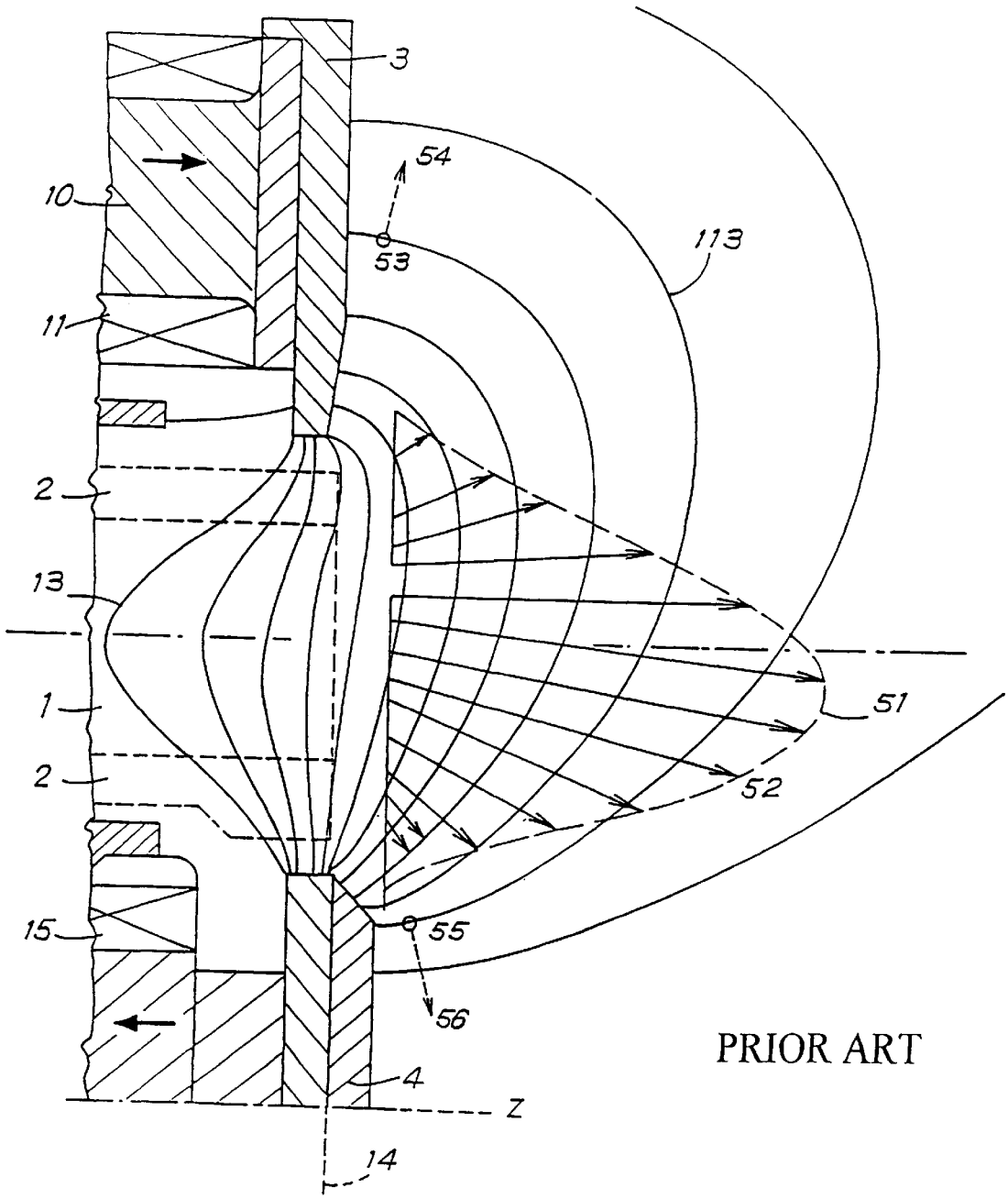
FIG. 7 is an axial section view through a portion of a prior art closed electron drift plasma thruster, showing ion density distribution superposed on magnetic field lines outside the acceleration channel.
Figure 8A:
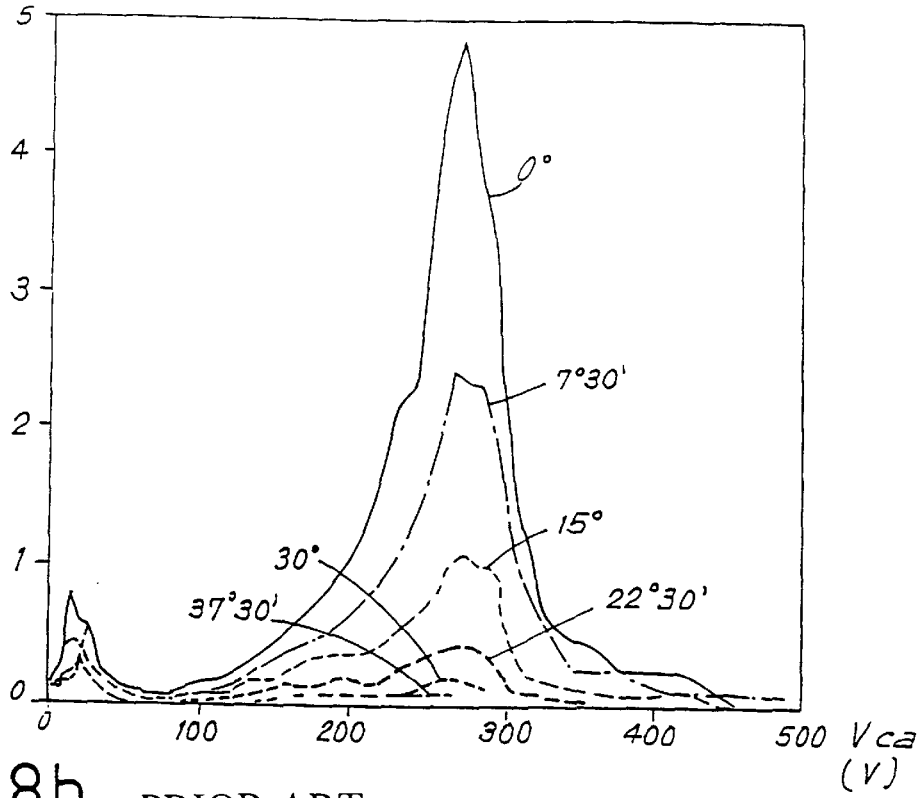
FIG. 8a PRIOR ART
FIGS. 8*a* and 8*b* are graphs on which the curves show ion current distribution as a function of energy for various orientations relative to the axis of the thruster in a prior art plasma thruster.
Figure 8B:
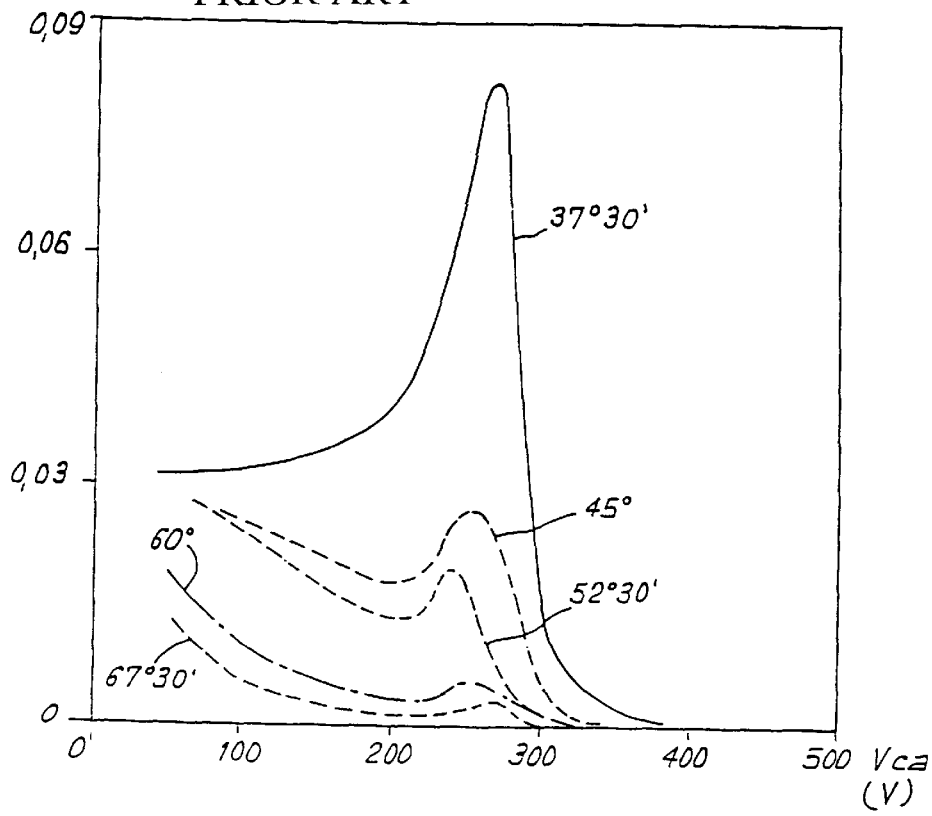
FIG. 8b PRIOR ART
Figure 9:
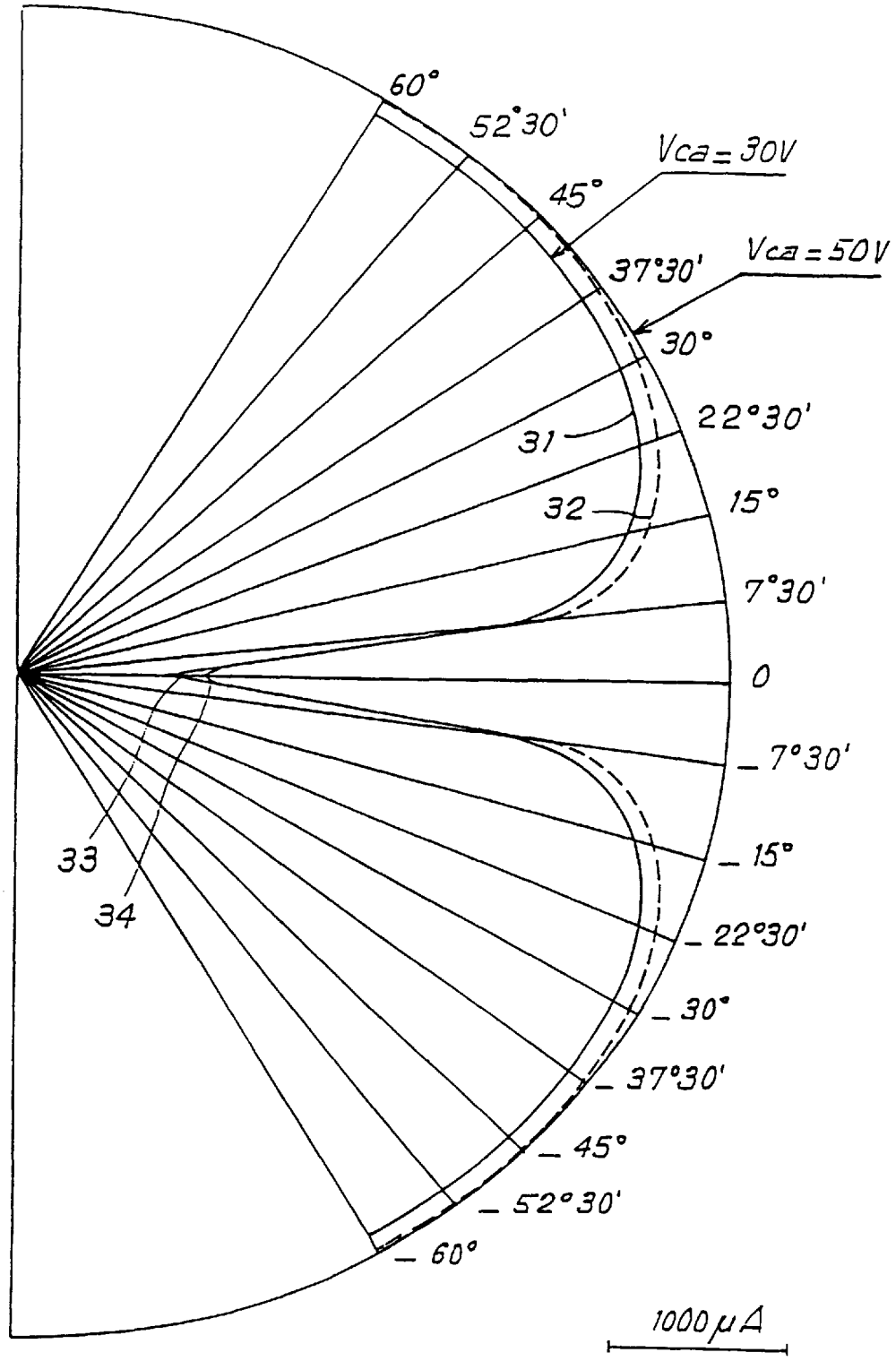
FIG. 9 shows the overall profile of an ion beam at the outlet from a prior art plasma thruster for two collectors of different voltages.

FIG. 1 is a view similar to FIG. 7 and shows an embodiment of ion beam-shaping means which, in accordance with the invention, are disposed downstream from the outlet plane 14 of a closed electron drift plasma thruster.

In FIG. 1, there can be seen the downstream portion of the annular acceleration channel 1 defined by pieces 2 of insulating material and represented by dashed lines, and the downstream portion of the main magnetic circuit for creating a magnetic field in the channel 1. The main magnetic circuit comprises a central pole piece 4 and a peripheral annular pole piece 3 situated in the vicinity of the outlet plane 14, together with a peripheral magnetic circuit 10, peripheral electromagnet coils 11, and electromagnet coils co-operating with the central pole piece 4, and also a yoke analogous to the yoke 12 in FIG. 6 but not shown in FIG. 1. The elements 1 to 4, 10, 11, and 15 of FIG. 1 can be made in similar manner to the corresponding elements in FIG. 7 which correspond to a prior art embodiment.

Figure 6:
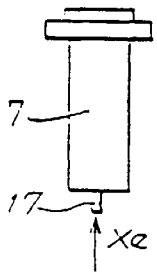
PRIOR ART FIG. 6
FIG. 6 is an axial section view showing a prior art embodiment of a closed electron drift plasma thruster.

Similarly, in conventional manner, in an embodiment that may, for example, be of the kind shown in FIG. 6, but without necessarily being identical thereto, the closed electron drift plasma thruster of FIG. 1 may comprise both an annular anode 5 concentric to the annular channel 1 and disposed at a certain distance upstream from the outlet of the channel 1, and ionizable gas feed means 6, e.g. for feeding xenon, associated with the annular anode 5. The plasma thruster of the invention further includes a hollow cathode 7 (not shown in FIG. 1 but visible in FIG. 2) which is disposed outside the channel 1, downstream therefrom, and associated with means 17 for feeding an ionizable gas such as xenon.

A main magnetic circuit produces a magnetic field whose field lines 13 are essentially radial in the outlet plane 14 perpendicular to the axis of the thruster. It is important to observe that the modifications to a plasma thruster by the invention do not alter the shape of the field lines 13 inside the annular channel 1, which field lines 13 inside the channel 1 are identical both in the case of the prior art thruster shown in FIG. 7 and in the case of the thruster of the invention shown in FIG. 1. In contrast, the magnetic field lines 113*a* downstream from the outlet plane 14 are strongly modified in the embodiment of FIG. 1 compared with the field lines 113 of FIG. 7.

The plasma thruster of FIG. 1 is fitted with an additional peripheral magnetic circuit 60 connecting the peripheral pole piece 3 situated outside the annular channel 1 to an essentially frustoconical flared magnetic pole piece 63 which is open at both ends, is coaxial with the axis of the annular channel 1, being situated downstream from the outlet plane 14, and flares in a downstream direction.

The frustoconical pole piece 63 co-operates with the additional peripheral magnetic circuit 60 and the pole pieces 3 and 4 situated on either side of the channel 1 to define the shape of the magnetic field downstream from the annular channel 1.

More particularly, the essentially frustoconical pole piece 63 may have a half-angle at the apex, $\alpha$, lying in the range 30° to 60°, and for example equal to about 45°.

The additional pole piece 63 may be connected to the main magnetic circuit 10, 3 via its outlet plane 14 by means of bars 60. These bars 60 may be constituted by simple ferromagnetic pieces without any magnetically active element (e.g. a permanent magnet, an electromagnet coil) being added either to the pole piece 63 or to the bars 60 constituting the additional peripheral magnetic circuit.

Nevertheless, it is preferable for magnetically active elements to be incorporated in the additional peripheral magnetic circuit. Thus, the bars 60 may be constituted by permanent magnets.

In an advantageous embodiment, the bars 60 are made of soft iron, and as shown in FIG. 1, they are surrounded by coils 61 wound in such a direction that the magnetic flux created in the additional peripheral magnetic circuit is directed in a direction opposite to that of the magnetic flux created in the peripheral magnetic circuit 10 disposed outside the annular channel 1 parallel to the axis of the thruster.

Figure 2:
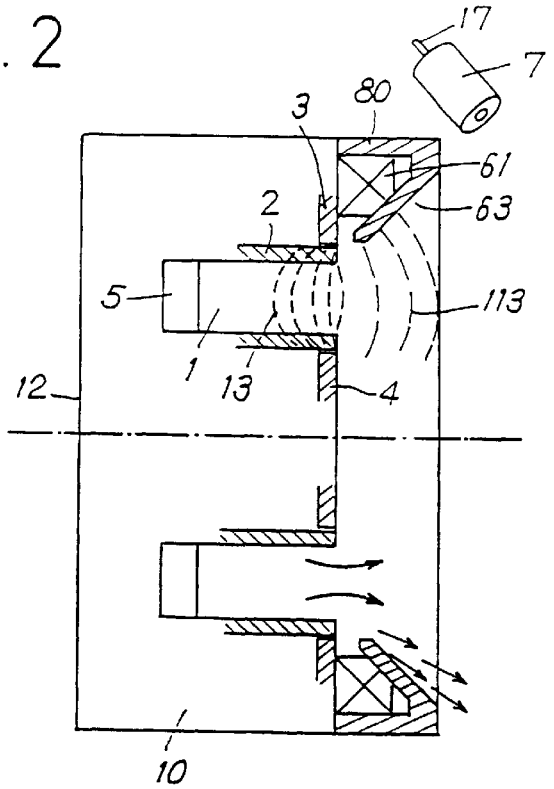
FIG. 2 is a diagrammatic axial section of an entire closed electron drift plasma thruster fitted with a beam-shaping device constituting a second particular embodiment of the invention.

FIG. 2 shows another embodiment of the invention in which the additional peripheral magnetic circuit 8 is constituted by a single ferromagnetic ring.

More particularly, FIG. 2 shows an embodiment in which the assembly comprising the essentially frustoconical pole piece 63 and the additional peripheral magnetic circuit 80 is constituted by a single piece fixed to the peripheral pole pieces situated at the outside of the annular channel 1, e.g. by bolts or by welding.

The frustoconical pole piece 63, the bars 60, or the ferromagnetic ring 80 may be made of an electrically insulating ferrite.

Figure 3:
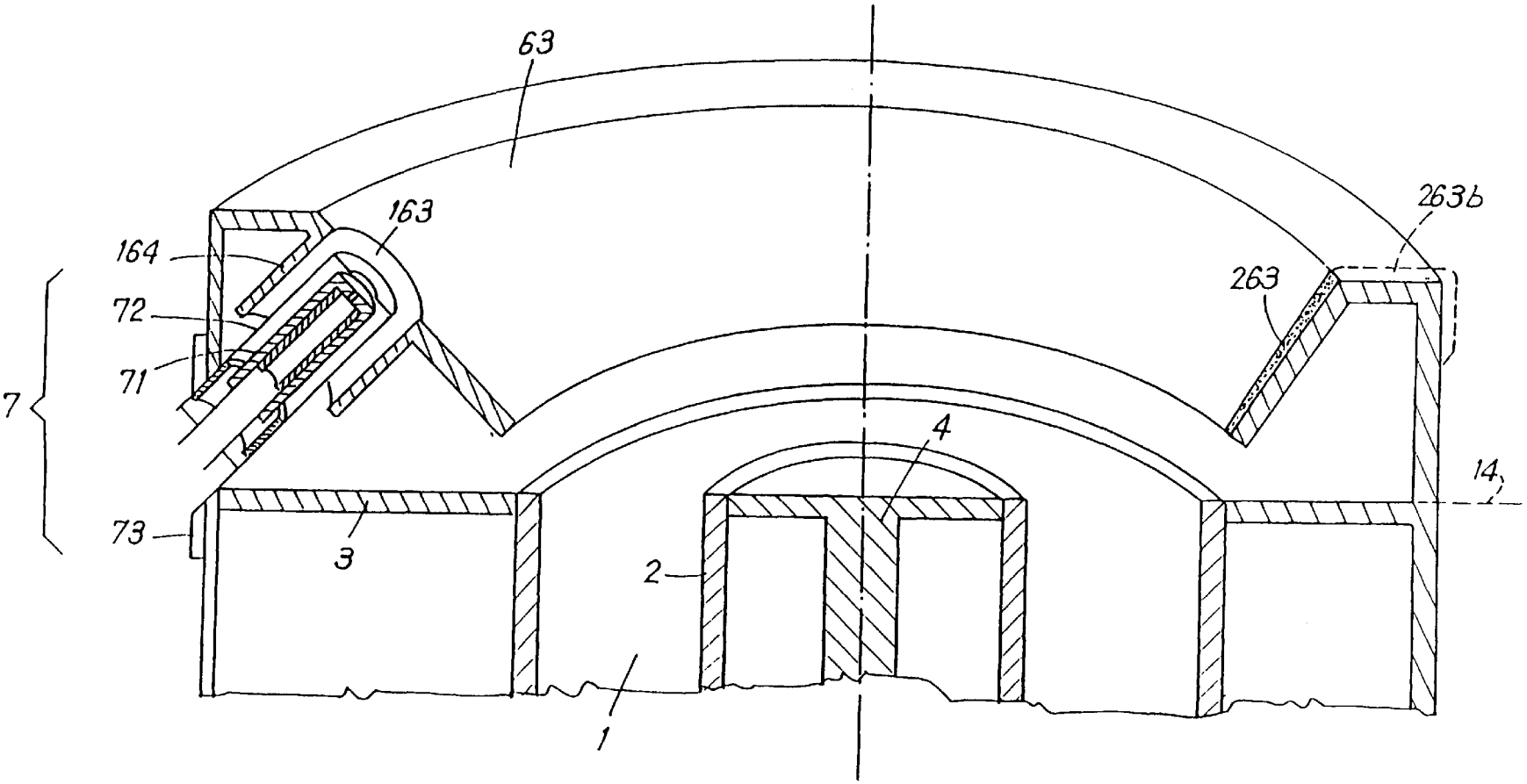
FIG. 3 is an axial section view of a portion of a closed electron drift plasma thruster fitted with a beam-shaping device of the invention in which a hollow cathode is incorporated.

As can be seen in the embodiment of FIG. 3, in a closed electron drift plasma thruster of the invention, the hollow cathode 7 may be incorporated in a hole 163 formed in the flared pole piece 63. In this case, the hollow cathode 7 is fitted with a protective ferromagnetic screen 164 facing the local magnetic field. The protective ferromagnetic screen 164 may be disposed around an ignition electrode 72 which itself surrounds the body 71 of the hollow cathode 7 which is fed with ionizable gas. The ignition electrode 72 and the tube 164 thus both contribute to making a thermally protective screen for the body 71. The hollow cathode 7 may be mounted on the pole pieces 3 and 63 by means of a flange 73. The axis of the cathode 7 is appropriately parallel to the local magnetic field lines.

The pole piece 63 forming the diverging portion of the thruster may be covered in a coating 263 (FIG. 3) that can perform several functions. Thus, the coating 262 may increase the emissivity of the surface of the piece so as to increase the radiation flux and thus reduce the operating temperature of the thruster.

The coating 263 may also provide electrical insulation.

Finally, the coating 263 may provide protection against contamination between the annular channel 1 and the flared pole piece 63.

A single layer of coating can satisfy all three objects. The coating 263 may also be extended by a coating 263*b* formed on the sides of the thruster (FIG. 3).

The coating 263, 263*b* may be made of a material that is identical to the material defining the annular channel 1.

By way of example, the coating 263, 263*b* may be made of one of the following materials, or by a combination thereof: aluminum, boron nitride, silica, aluminum nitride, silicon nitride, $Al_2O_3$—$TiO_2$, and TiN.

Figure 4:
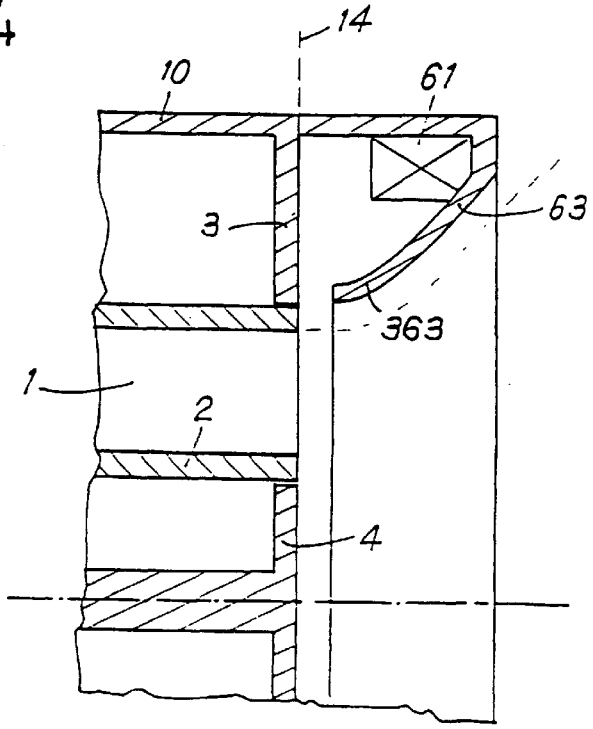
FIG. 4 is an axial section view showing a variant embodiment of a beam-shaping device of the invention applied to a closed electron drift plasma thruster.

FIG. 4 shows a variant embodiment of the invention in which the additional pole piece 63 is not exactly frustoconical in shape, but rather flares in a trumpet-like shape, the flared pole piece 63 having curvature 363 such that the angle formed by said piece relative to the axis of the thruster increases on going away from the outlet plane 14 in a downstream direction, thereby enabling the magnetic field lines to spread out progressively.

With reference again to FIG. 1, it can be seen that the lines 113*a* of the magnetic field outside the annular channel 1 are less convex than the lines 113 of FIG. 7, whereas the magnetic field lines 13 inside the channel 1 are practically unchanged.

Ions formed and accelerated outside the channel 1 are forced to remain inside a cone defined by the additional pole piece 63. This additional pole piece 63, the associated additional magnetic circuit 60, 61, and the pole pieces 3, 4 all co-operate to shape the magnetic field, and thus the equipotential lines 113*a* downstream from the outlet plane 14 of the thruster. An ion created at a point 53*a* is accelerated along a vector 54*a* in a direction normal to an equipotential surface, which corresponds very closely to a magnetic field line. It can thus be seen that ions accelerated at the periphery of the ion beam are practically parallel to the piece 63 and can remain inside the cone whose half-angle at the apex is determined by the half-angle at the apex $\alpha$ of the frustoconical piece 63 or by the flared piece that can be considered as being a truncated cone.

In general, in a plasma thruster of the invention, ion density is increased in the vicinity of the axis and is greatly decreased in a zone eccentric therefrom. The ion beam is thus better collimated, thus optimizing its use in industrial applications and reducing the risks of contamination under all circumstances.

Figure 5:
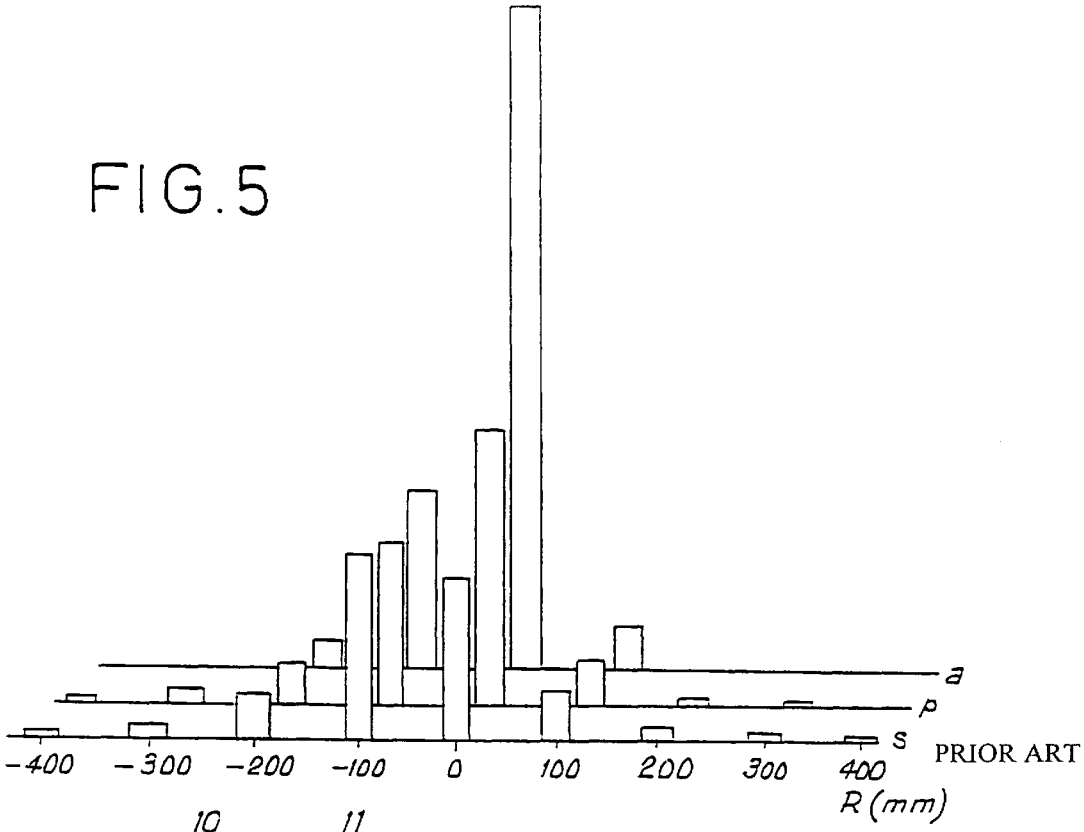
FIG. 5 comprises comparative histograms of the ion beam profile for a standard plasma thruster and for two different embodiments of plasma thrusters fitted with beam-shaping devices of the invention.
Figure 5:
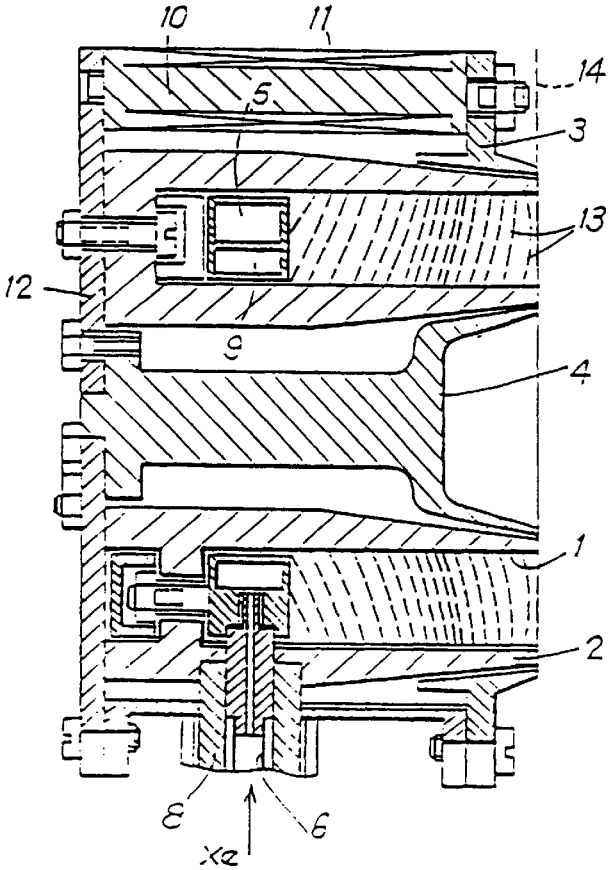

FIG. 5 shows three histograms giving the profile of an ion beam at a distance of 500 mm from the outlet of the thruster for the following three cases:

S) a standard prior art plasma thruster;

P) a plasma thruster of the invention fitted with a passive magnetic field shaping circuit at the outlet of the thruster, such a passive circuit comprising a pole piece 63 and an additional magnetic circuit 60 without active magnetic elements such as permanent magnets or electromagnets; and A) a plasma thruster constituting a preferred embodiment of the invention in which the magnetic field shaping circuit 60, 63 at the outlet from the thruster is of the active type, including active magnetic elements such as permanent magnets or electromagnets.

With reference to the histogram S showing the divergence of an ion beam from a standard plasma thruster, it can be seen that ion density at the edges is not negligible while ion density in the vicinity of the axis remains moderate.

Histogram P shows the improvement obtained when using a plasma thruster fitted by the invention with additional magnetic field shaping means 63, 60, such as the means 63, 60 of FIG. 1, for example, assuming that the coils 61 are not excited, which corresponds to means of the passive type. In this case, it can be seen that ion density in the vicinity of the axis is increased while ion density on the edges is decreased.

Histogram A corresponds to implementing additional maanetic field shaping means 63, 60 of the active type, i.e., for example, the embodiment of FIG. 1 with the coils 61 excited. In this case, it can be seen that ion density in the vicinity of the axis is multiplied substantially by a factor of three, while density at the edges is entirely negligible.

We claim:

1. A closed electron drift plasma thruster comprising:

an annular ionization and acceleration channel defined by pieces of insulating material having an opening at its downstream end;

at least one hollow cathode disposed outside said annular channel and downstream therefrom;

an annular anode concentric with the annular channel and disposed upstream from the opening of said channel, and at a distance therefrom;

first and second ionizable gas feed means respectively associated with the hollow cathode and with the annular anode; and a magnetic circuit for creating a magnetic field in the annular channel, said magnetic circuit comprising a plurality of distinct magnetic field creating means a yoke, a peripheral magnetic circuit disposed axially outside the annular channel, and peripheral and central pole pieces connected to one another by said peripheral magnetic circuit and said yoke and disposed on either side of the annular channel to produce an essentially radial magnetic field in an outlet plane perpendicular to the axis of said annular channel;

the thruster being characterized in that it further comprises:

an essentially frustoconical flared magnetic pole piece open at both ends, coaxial about the axis of the annular channel, situated downstream from said outlet plane, and flaring downstream; and at least one additional peripheral magnetic circuit connecting the downstream end of said flared magnetic pole piece to the peripheral pole piece situated outside the auxiliary channel, the flared magnetic pole piece co-operating with the additional peripheral magnetic circuit and the pole pieces situated on either side of the annular channel to define the shape of the magnetic field downstream from the annular channel in such a manner as to constrain the ion beam emitted by the annular channel to remain within an essentially conical zone whose determined angle at the apex is defined by the angle at the apex of the flared pole piece.

2. A plasma thruster according to claim 1, characterized in that the half-angle at the apex, $\alpha$, of the essentially frustoconical flared pole piece lies in the range 30° to 60°.

3. A plasma thruster according to claim 2, characterized in that the half-angle at the apex, α, of the essentially frustoconical flared pole piece is about 45°.

4. A plasma thruster according to claim 1, characterized in that the flared pole piece is curved such that the angle formed by said piece relative to the axis of the thruster increases on going away from the outlet plane (14) in the downstream direction, thereby enabling the magnetic field lines to spread apart progressively.

5. A plasma thruster according to claim 1, characterized in that flared pole piece is covered in a coating for increasing the emissivity of the surface of said piece, for providing electrical insulation, or for providing protection against contamination between the annular channel and the flared pole piece.

6. A plasma thruster according to claim 5, characterized in that said coating is made of a material identical to that of the pieces defining said annular channel.

7. A plasma thruster according to claim 5, characterized it that said coating is constituted by at least one of the following materials: aluminium, boron nitride, silica, aluminum nitride, silicon nitride, $Al_2O_3$—$TiO_2$, and TiN.

8. A plasma thruster according to claim 1, characterized in that the flared pole piece and the additional peripheral magnetic circuit are made of ferromagnetic material without adding a permanent magnet or an electromagnet coil.

9. A plasma thruster according to claim 1, characterized in that at least one of the elements constituted by the flared pole piece (63) and the additional peripheral magnetic circuit (60; 80) is made of electrically insulating ferrite.

10. A plasma thruster according to claim 1, characterized in that the additional peripheral magnetic circuit is constituted by a single ferromagnetic ring.

11. A plasma thruster according to claim 10, characterized in that the flared pole piece and the additional peripheral magnetic circuit are together constituted by a single piece fixed on the peripheral pole piece situated outside the annular channel.

12. A plasma thruster according to claim 1, characterized in that the hollow cathode is incorporated in a hole formed in the flared pole piece (63) and is provided with a protective ferromagnetic screen facing the local magnetic field.

13. A plasma thruster according to claim 12, characterized in that the protective ferromagnetic screen is disposed around an ignition electrode itself surrounding the body (71) of the hollow cathode.

14. A plasma thruster according claim 1, characterized in that the additional peripheral magnetic circuit comprises ferromagnetic bars.

15. A plasma thruster according to claim 14, characterized in that said ferromagnetic bars are constituted by permanent magnets.

16. A plasma thruster according to claim 14, characterized in that said ferromagnetic bars are made of soft iron and are surrounded by coils wound in such a direction that the magnetic flux created in the additional peripheral magnetic circuit is directed in a diction opposite to that of the magnetic flux created in said peripheral magnetic circuit disposed axially outside the annular channel.

17. Ion beam concentration apparatus for a plasma thruster having closed electron drift, the apparatus being characterized in that it comprises:

a) an essentially frustoconical flared magnetic pole piece open at both ends and designed to be situated downstream from the outlet plane of a plasma thruster having an annular ionization and acceleration channel and peripheral and central pole pieces disposed on either side of the annular channel to produce an essentially radial magnetic field in an outlet plane (14) perpendicularly to the axis of the annular channel (1); and b) an additional peripheral magnetic circuit connecting the downstream end of the flared magnetic pole piece to said peripheral pole piece, the flared magnetic pole piece co-operating with the additional peripheral magnetic circuit and with the peripheral and central pole pieces to define the shape of the magnetic field downstream from the annular channel in such a manner as to constrain the ion beam emitted by the annular channel to remain within an essentially conical zone whose predetermined angle at the apex is defined by the angle at the apex of the flared magnetic pole piece.

18. A plasma thruster according to claim 2, characterized in that:

the flared pole piece is curved such that the angle formed by said piece relative to the axis of the thruster increases on going away from the outlet plane in the downstream direction, thereby enabling the magnetic field lines to spread apart progressively;

that flared pole piece is covered in a coating for increasing the emissivity of the surface of said piece, for providing electrical insulation, or for providing protection against contamination between the annular channel and the flared pole piece;

said coating is made of a material identical to that of the pieces defining said annular channel;

said coating is constituted by at least one of the following materials: aluminum, boron nitride, silica, aluminum nitride, silicon nitride, $Al_2O_3$—$TiO_2$, and TiN;

the flared pole piece and the additional peripheral magnetic circuit are made of ferromagnetic material without adding a permanent magnet or an electromagnet coil;

at least one of the elements constituted by the flared pole piece and the additional peripheral magnetic circuit is made of electrically insulating ferrite;

the additional peripheral magnetic circuit is constituted by a single ferromagnetic ring;

the flared pole piece and the additional peripheral magnetic circuit are together constituted by a single piece fixed on the peripheral pole piece situated outside the annual channel;

the hollow cathode is incorporated in a hole formed in the flared pole piece and is provided with a protective ferromagnetic screen facing the local magnetic field; and the protective ferromagnetic screen is disposed around an ignition electrode itself surrounding the body of the hollow cathode.

19. A plasma thruster according to claim 7, characterized in that:

the additional peripheral magnetic circuit comprises ferromagnetic bars; and said ferromagnetic bars are constituted by permanent magnets.

20. A plasma thruster according to claim 19, characterized in that said ferromagnetic bars are made of soft iron and are surrounded by coils wound in such a direction that the magnetic flux created in the additional peripheral magnetic circuit is directed in a diction opposite to that of the magnetic flux created in said peripheral magnetic circuit disposed axially outside the annular channel.

* * * * *

UNITED STATES PATENT AND TRADEMARK OFFICE

CERTIFICATE OF CORRECTION

PATENT NO. : 6,158,209 
DATED : December 12, 2000
INVENTOR(S) : Leonid Aleckseevich Latischev et al.

It is certified that error appears in the above-identified patent and that said Letters Patent is hereby corrected as shown below:

Column 8,
Line 18, "maanetic" should read -- magnetic --;

Column 9,
Line 7, "plane (14) in" should read -- plane in --;
Line 29, "piece (63) and" should read -- piece and --;
Lines 29-30, "circuit (60;80) is" should read -- circuit is --;
Line 42, "piece (63) and" should read -- piece and --;
Line 45, "body (71)" should read -- body --;

Column 10,
Line 2, "plane (14)" should read -- plane --;
Line 3, "channel (1);" should read -- channel; --.

Signed and Sealed this

Twenty-seventh Day of August, 2002

*Attest:*

*Attesting Officer*

JAMES E. ROGAN
*Director of the United States Patent and Trademark Office*